United States Patent [19]

Senger et al.

[11] Patent Number: 4,713,952

[45] Date of Patent: Dec. 22, 1987

[54] TOOL AND METHOD FOR ROTOPEENING THE PERIPHERAL TUBES IN A TUBESHEET

[75] Inventors: Robert D. Senger, Unity Township, Westmoreland County; William E. Pirl, Trafford; Charles H. Roth, Jr., North Huntingdon, all of Pa.

[73] Assignee: Westinghouse Electric Corp., Pittsburgh, Pa.

[21] Appl. No.: 826,453

[22] Filed: Feb. 5, 1986

[51] Int. Cl.[4] ..... B21D 7/06

[52] U.S. Cl. ..... 72/53; 51/334; 51/332; 29/90 A

[58] Field of Search ..... 51/334, 411, 241 B, 51/337, 332, 401, 402, 294, 298, 241 S, 241 R; 72/53, 40, 466, 110, 199, 234, 362, 365; 29/90 A

[56] References Cited

U.S. PATENT DOCUMENTS

| | | | |
|---|---|---|---|
| 2,778,865 | 1/1957 | Kongsgaarden | 13/16 |
| 2,873,580 | 2/1959 | Suderow | 61/46.5 |
| 2,929,653 | 3/1960 | Hund et al. | 294/64 |
| 3,015,142 | 1/1962 | Rosanoff et al. | 24/263 |
| 3,052,494 | 9/1962 | Williamson | 294/93 |
| 3,118,555 | 1/1964 | Bent et al. | 214/651 |
| 3,144,148 | 8/1964 | Merkner | 214/304 |
| 3,485,073 | 12/1969 | Burney | 72/53 |
| 3,531,964 | 10/1970 | Manning, Jr. et al. | 72/53 |
| 3,542,354 | 11/1970 | Fitzpatrick | 269/22 |
| 3,574,386 | 4/1971 | Frost | 294/87 |
| 3,648,498 | 3/1972 | Voss et al. | 72/53 |
| 3,654,786 | 4/1972 | Koenecke et al. | 72/53 |
| 3,714,770 | 2/1973 | Rothke | 57/52 |
| 3,791,011 | 2/1974 | Keys | 29/252 |
| 3,805,359 | 4/1974 | Webb | 29/280 |
| 3,834,200 | 9/1974 | Winter | 72/53 |
| 3,857,158 | 12/1974 | Costello | 29/247 |
| 3,857,750 | 12/1974 | Winter et al. | 72/53 |

(List continued on next page.)

FOREIGN PATENT DOCUMENTS

| | | |
|---|---|---|
| 658351 | 2/1963 | Canada . |
| 2458567 | 7/1975 | Fed. Rep. of Germany . |
| 2845094 | 10/1978 | Fed. Rep. of Germany . |

OTHER PUBLICATIONS

R. R. Murray "Longer Life for Metal Parts by Shot Peening", Mar. 22, 1984.

"3M Brand Roto Peen Flap Assemblies Type T.C. 330", 3M Technical Data.

*Primary Examiner*—Robert L. Spruill

*Assistant Examiner*—David B. Jones

[57] ABSTRACT

An improved apparatus and process for rotopeening metallic conduits of limited accessibility, such as the peripherally located heat exchange tubes around the tubesheet of a nuclear steam generator, is disclosed herein. The bowl-like inner wall which lies directly adjacent to such peripherally-located tubes renders it difficult to insert a rotopeening spindle into the open ends of these tubes in order to work-harden these tubes in the tubesheet region. Generally, the apparatus of the invention comprises at least one flexible rotopeening spindle, an advancing mechanism for remotely and incrementally advancing the flexible spindle through an open end of a selected peripheral tube, and a frame for supporting both the flexible spindle and the advancing mechanism. The length of the advancing mechanism is substantially shorter than the length of the flexible spindle so that the spindle and the advancing mechanism may be easily placed into a peening position with respect to the most remotely located tubes. The advancing mechanism includes first and second grippers which utilize expandable bladders for selectively gripping and ungripping the spindle. The first gripper is mounted on the wall-facing side of the frame, and the second gripper is reciprocably movable with respect to the first gripper. Additionally, the second gripper is rotatable and is mechanically linked to a drive means, in order to render it capable of rotating the rotopeening spindle once it is inserted into a selected tube end.

36 Claims, 7 Drawing Figures

U.S. PATENT DOCUMENTS

| | | | |
|---|---|---|---|
| 3,886,774 | 6/1975 | Stromstedt et al. | 72/53 |
| 3,892,437 | 7/1975 | Makinen | 294/93 |
| 3,915,311 | 10/1975 | Ball et al. | 214/1 QD |
| 3,936,089 | 2/1976 | Hoffmeister | 294/86 A |
| 3,950,020 | 3/1976 | Hoffmeister | 294/86 A |
| 4,005,896 | 2/1977 | Ball et al. | 294/67 BA |
| 4,034,585 | 7/1977 | Straub | 72/53 |
| 4,104,790 | 8/1978 | Hindrichs | 29/107 |
| 4,125,928 | 11/1978 | Cawley et al. | 29/282 |
| 4,173,368 | 11/1979 | Haverbusch | 294/88 |
| 4,236,967 | 12/1980 | Batjukov et al. | 176/30 |
| 4,277,052 | 7/1981 | Kallinger | 254/106 |
| 4,286,416 | 9/1981 | Cooper, Jr. | 51/334 |
| 4,347,652 | 9/1982 | Cooper, Jr. et al. | 29/407 |
| 4,354,371 | 10/1982 | Johnson | 72/53 |
| 4,374,462 | 2/1983 | Wojcik et al. | 51/411 |
| 4,406,856 | 9/1983 | Wilkins et al. | 376/260 |
| 4,410,210 | 10/1983 | de Sivry et al. | 294/99 R |
| 4,479,547 | 10/1984 | Boyadjieff et al. | 166/383 |
| 4,481,802 | 11/1984 | Harman et al. | 72/53 |
| 4,491,001 | 1/1985 | Yoshida et al. | 72/53 |
| 4,586,250 | 5/1986 | Cooper, Jr. et al. | 29/727 |
| 4,615,198 | 10/1986 | Hawkins et al. | 72/122 |

FIG 6
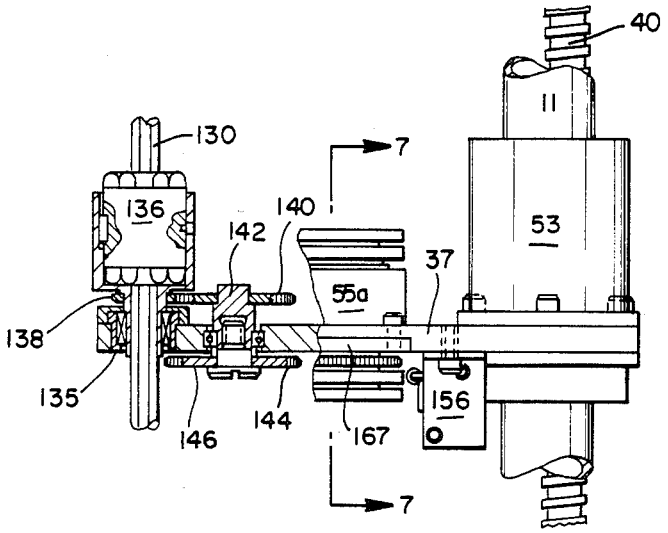
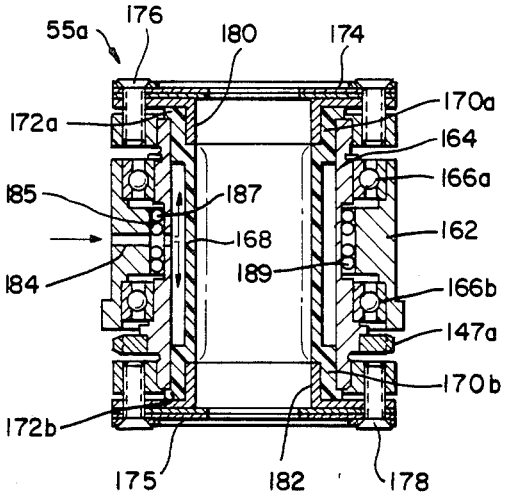
FIG 7

TOOL AND METHOD FOR ROTOPEENING THE PERIPHERAL TUBES IN A TUBESHEET

BACKGROUND OF THE INVENTION

1. Field of the Invention

This invention relates to a device capable of remotely peening the interior walls of tubes located in areas of limited accessibility. It is particularly useful in rotopeening the heat exchange tubes mounted in the peripheral areas of the tubesheet of a nuclear steam generator in order to relieve tensile stresses in the inside wall of these tubes.

2. Description of the Prior Art

Devices for peening the inside walls of metallic tubes are generally known in the prior art. Such devices are particularly useful in relieving or at least equilibrating the tensile stresses which may be induced across the wall of a metallic tube when that tube is radially expanded, as by a hydraulic mandrel or a cold-rolling tool. Such stress-causing expansions are routinely performed in the heat exchange tubes of nuclear steam generators, particularly in the vicinity of the generator tubesheet, during both the manufacture and the maintenance of the nuclear steam generator. Unfortunately, such stresses can lead to an undesirable phenomenon known as "stress corrosion cracking" in the walls of such tubes if not relieved in some way. In order to fully understand the dangers associated with such stress corrosion cracking, and the utility of the invention in preventing such cracking, some general background as to the structure, operation, and maintenance of nuclear steam generators is necessary.

Nuclear steam generators are comprised of three principal parts, including a secondary side and a tubesheet, as well as a bowl-shaped primary side which circulates water heated from a nuclear reactor. The secondary side of the generator includes a plurality of U-shaped heat exchange tubes, as well as an inlet for admitting a flow of feedwater. The inlet and outlet ends of the U-shaped tubes within the secondary side of the generator are mounted in bores in the tubesheet. The tubesheet hydraulically isolates the primary side of the generator from the secondary side. The primary side in turn includes a divider sheet which hydraulically isolates the inlet ends of the U-shaped tubes from the outlet ends. Hot, radioactive water flowing from the nuclear reactor is admitted into the inlet section of the primary side which contains all the inlet ends of the U-shaped tubes. This hot, radioactive water enters the inlet ends of the tubes, flow up through the tubesheet, and circulates around the U-shaped tubes which extend within the secondary side of the generator. As it circulates, this water transfers its heat through the walls of the tubes to the non-radioactive feedwater flowing through the secondary side of the generator, thereby converting the feedwater into non-radioactive steam. This steam in turn powers the turbines of an electric generator. After the water from the reactor circulates through the U-shaped tubes, it flows back through the tubesheet, through the outlets of the U-shaped tubes, and into the outlet section of the primary side where it is recirculated back to the nuclear reactor.

The walls of the heat exchange tubes in such nuclear steam generators can suffer a number of different forms of corrosion degradation, including denting, stress corrosion cracking, intragranular attack, and pitting. In situ examination of the tubes within these generators has revealed that most of this corrosion degradation occurs in what are known as the crevice regions of the generator. The principal crevice region for each of these U-shaped tubes is the annular space between the heat exchange tube and the bore in the tubesheet through which the tube extends. Corrosive sludge tends to collect within this annular crevice from the effect of gravity. Moreover, the relatively poor hydraulic circulation of the water in this region tends to maintain the sludge in this annular crevice, and to create localized "hot spots" in the tubes adjacent the sludge. The heat radiating from these "hot spots" acts as a powerful catalyst in causing the exterior walls of the heat exchange tubes to chemically combine with the corrosive chemicals in the sludge.

While most nuclear steam generators include blowdown systems for periodically sweeping the sludge out of the generator vessel with a jet of water, the sludges in the tubesheet crevice regions are not easily swept away by the hydraulic currents produced by such systems. Despite the fact that the heat exchange tubes of such generators are typically formed from corrosion-resistant Inconel® stainless steel, the combination of the localized regions of heat and concentrated corrosive sludge can ultimately corrode the walls of the heat exchange tubes until they crack. When this happens, the tubes begin to leak radioactive water from the primary side into the secondary side of the generator. This, in turn, results in radioactively contaminated steam flowing to the generators of the power plant.

In order to prevent such corrosion and tube cracking from occurring, various processes have been developed for radially expanding the sections of the tubes extending through the tubesheet so as to eliminate, or at least minimize, the annular space between the bores in the tubesheet and the heat exchange tubes. Such radial expansions may be implemented by hydraulic mandrels capable of applying fluid pressures of nearly 10,000 psi across selected sections of the tubes, or by cold-rolling tools which utilize pitched, tapered rollers capable of screwing into the open ends of the tubes and widening them until their outer walls engage the inner walls of the surrounding bore in the tubesheet. Unfortunately, such tube expansions create tensile stresses throughout the walls of the tubes in the tubesheet region which render them more susceptible to corrosion, thereby partially defeating the purpose of the tube expansion.

Because the metal around the inner diameter of the tube is expanded a relatively greater amount than the metal forming the outer diameter of the tube, most of the tensile stress caused by such radial expansions is concentrated in the inner wall of the tube. In order to relieve this tensile stress, rotopeening devices have been developed which are capable of peening and stress relieving the inner tube walls. However, most of these devices cannot be used to peen the heat exchange tubes located in the periphery of the tubesheet due to the fact that the open ends of these tubes are directly adjacent to the inwardly curving interior wall of the bowl-shaped primary side of the nuclear steam generator. To appreciate the spatial limitations imposed by the bowl and the tubesheet geometry in such generators, reference is made to the various figures of U.S. Pat. No. 4,262,402 (assigned to the Westinghouse Electric Corporation), which illustrate a side, cross-sectional view of the tubesheet and bowl-shaped primary side of such nuclear steam generators.

So far as applicant knows, only one rotopeening device has been specifically designed for use in these peripheral tubesheet regions. This device is described and claimed in U.S. patent application Ser. No. 731,241 filed May 7, 1985, now U.S. Pat. No. 4,616,496 by Phillip J. Hawkins and assigned to the Westinghouse Electric Corporation. Generally, this rotopeening device utilizes a rotopeening spindle having a flexible housing formed from a plurality of segments interconnected by means of two-way dogleg joints. A plurality of peening flappers are mounted on a flexible mandrel which in turn is rotatably mounted within the spindle housing. The use of such a flexible housing and flexible mandrel renders the entire spindle flexible. If rigid rotopeening spindles were utilized, the inwardly directed curvature of the bowl-shaped wall of the primary side of the generator would mechanically interfere with the alignement and insertion of the spindle into the open end of these peripherally located tubes. However, because the spindle or spindles used are flexible, these spindles can be bent to conform with the curvature of the bowl-shaped walls, and easily aligned and inserted into the open ends of such peripheral tubes. Unfortunately, this tool possesses one substantial shortcoming—it would be difficult, if not possible, to remotely insert the flexible spindles of this tool into the open ends of peripherally located tubes by means of known robotic devices, such as the ROSA developed and patented by the Westinghouse Electric Corporation. The flexibility of such spindles causes them to assume a naturally curved or "slumped" orientation when supported only at their bottom portions, thereby making it very difficult to insert the upper ends of these spindles into the open ends of the tubes to be rotopeened. And even if this were accomplished, other problems would arise if such a robotic arm were simply moved vertically in an attempt to insert the entire length of the flexible spindle into the tube. Specifically, the flexibility of the spindle, coupled with its curved or slumped attitude, would cause a vertical force component generated by the robotic arm to be transmitted out the side of this flexible spindle, thereby merely folding and breaking it, rather than threading it through the tube. In short, the problem to be solved is somewhat like attempting to thread a length of wet spaghetti through the bottom end of a vertically oriented tube glued to the inside wall of a fishbowl by holding the bottom end of the length of spaghetti and pushing up. This is a substantial shortcoming, since the radioactive environment present in the primary sides of "hot", in-service nuclear steam generators renders it very desirable to use robotics, rather than human operators, to implement all stages of a rotopeening process.

Clearly, there is a need for a peening apparatus capable of quickly, reliably and remotely peening the inner walls of the heat exchange tubes mounted around the periphery of the tubesheet of "hot" nuclear steam generators. Ideally, such an apparatus would be mechanically uncomplicated, and easily positionable into the open ends of the most remotely located tubes with preexisting robotic devices, such as the ROSA.

SUMMARY OF THE INVENTION

In its broadest sense, the invention is an improved apparatus for rotopeening the inside wall of a conduit having an open end of limited accessibility, such as a heat exchange tube located on the periphery of the tubesheet of a stream generator. The apparatus generally comprises a flexible rotopeening spindle of length L1, and a spindle advancing means of maximum length L2 for remotely and incrementally advancing and withdrawing the flexible spindle into and out of the open end of a conduit or tube.

The apparatus includes a frame for supporting both the flexible rotopeening spindle and the advancing means. When the apparatus is used to rotopeen the tubes around the periphery of a tubesheet which lies adjacent to an inwardly curving wall, both the flexible spindle and the advancing means may be located on the side of the frame which will face the wall when the spindle is advanced into an open tube end. Additionally, the maximum length L2 of the advancing means may be made substantially less than the maximum length L1 of the flexible rotopeening spindle in order to allow the wall-facing side of the advancing means to be easily positioned adjacent to a peripheral tube with the flexible spindle in alignment with the open tube end.

The advancing means may be formed from first and second selectively actuatable grippers, at least one of which is reciprocably movable with respect to the other for advancing the flexible spindle into the open tube end. The first gripper may be fixedly mounted on the wall-facing side of the frame, and the second gripper may be reciprocably movable with respect to the first gripper. Both the first and second grippers may include expandable bladders for selectively gripping and ungripping the flexible housing of the spindle. Further, the gripping bladder of the second gripper may be rotatably mounted and connected to a drive means so that the second gripper can serve the additional function of rotating the outer housing of the rotopeening spindle at the same time the peening flappers are rotated by the spindle mandrel. This is important, since such a rotational movement will add an orbital component of motion to the rotopeening flappers. Such an orbital component of motion is necessary if the peening flappers are to uniformly peen the inside walls of the tubes.

The frame of the apparatus may further include a top plate having a mounting and alignment means for both detachably mounting the frame to the tubesheet, and aligning the spindle passageways of the upper grippers into registry with the open ends of a pair of selected tubes. In the preferred embodiment, the mounting and alignment means includes a vertically movable and expandable collet capable of being inserted and expanded into the open end of a tube not being rotopeened, in order to detachably connect the frame to this tube. The mounting and alignment means may further include a means for slidably connecting this expandable collet onto the frame of the apparatus, as well as a pneumatic cylinder whose piston is linked between the frame and the expandable collet so that the collet may be slidably moved relative to the frame before the collet is secured into the open end of a tube not being rotopeened.

Finally, the invention also includes a process for rotopeening a selected conduit with a flexible rotopeening spindle and an advancing means as described above. This process comprises the steps of gripping the spindle with at least one of the grippers with the distal end of the spindle positioned below the distal end of the first gripper, positioning the frame so that the distal end of the spindle is aligned with an open end of a selected conduit, and advancing the flexible spindle into the conduit. Such advancement is effected by ungripping the spindle with the first gripper and gripping the spindle with the second gripper while moving the second gripper to a position closer to the open conduit end, and then gripping the spindle with the first gripper and ungripping the spindle with the second gripper while moving the second gripper to a position farther away from the open conduit end. These steps are repeated until the entire length of the flexible spindle is inserted. The process of the invention may further include the step of rotating the flexible spindle housing after the spindle has been inserted into the open end of the conduit during a peening operation, as well as withdrawing the spindle out of the conduit after the rotopeening operation has been completed. Such withdrawal is effected by reversing the sequence of the spindle advancement steps.

Both the apparatus and the process of the invention provide an improved tool for rotopeening the peripherally located tubes in the tubesheet of a steam generator which is remotely positionable into the open ends of these tubes by means of a prior art robotic arm, and which will reliably advance and withdraw a flexible rotopeening spindle into and out of the least accessible of these tubes.

BRIEF DESCRIPTION OF THE SEVERAL FIGURES

FIG. 6 is a partial cross-sectional side view of the rotopeening apparatus illustrated in FIG. 1, and FIG. 7 is a cross-sectional side view of one of the rotatable bladder grippers of the invention.

DETAILED DESCRIPTION OF THE PREFERRED EMBODIMENT

General Overview of the Structure and Function of the Invention

Figure 1:
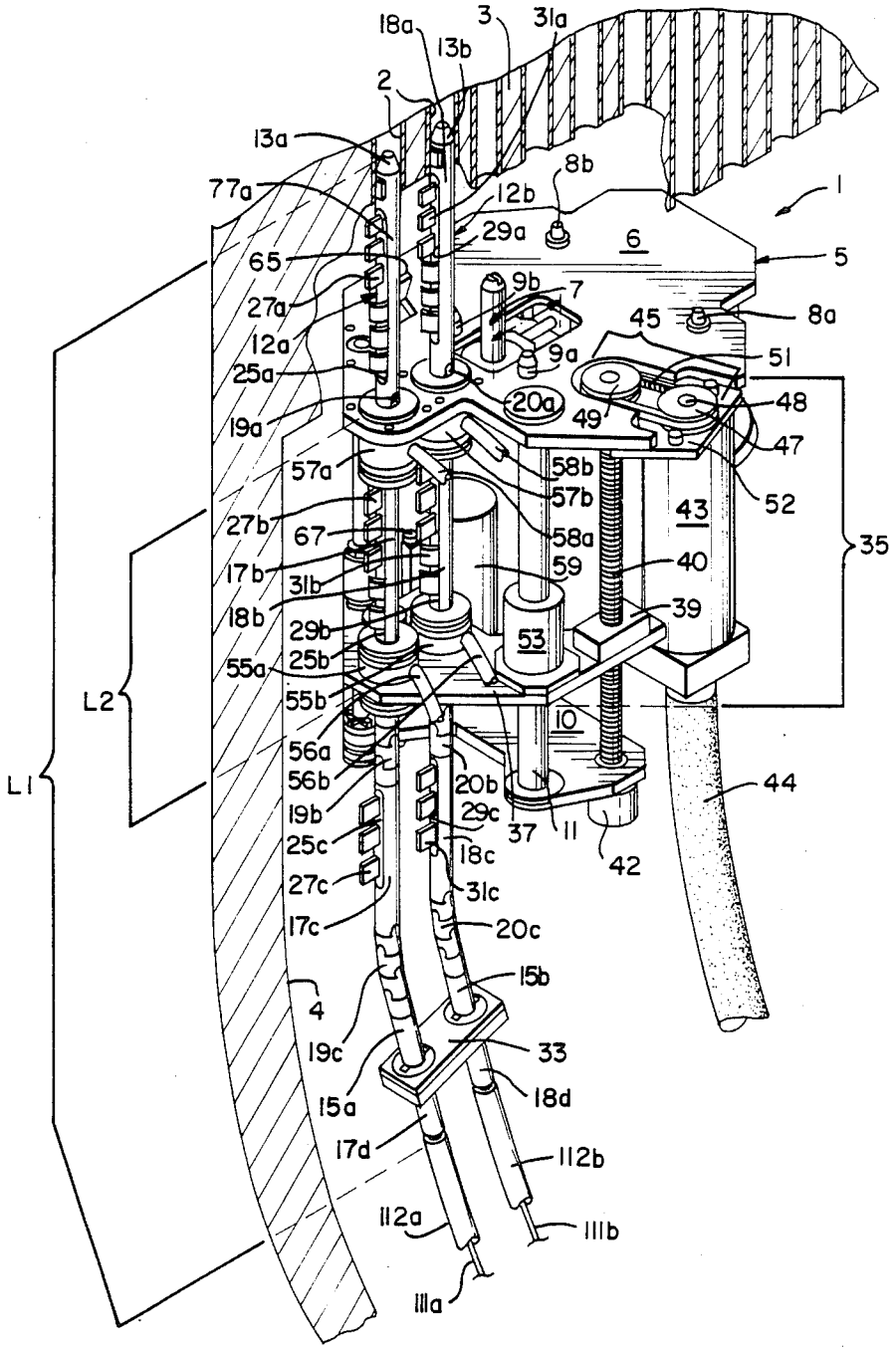
FIG. 1 is a perspective view of the preferred embodiment of the rotopeening apparatus of the invention.
Figure 2:
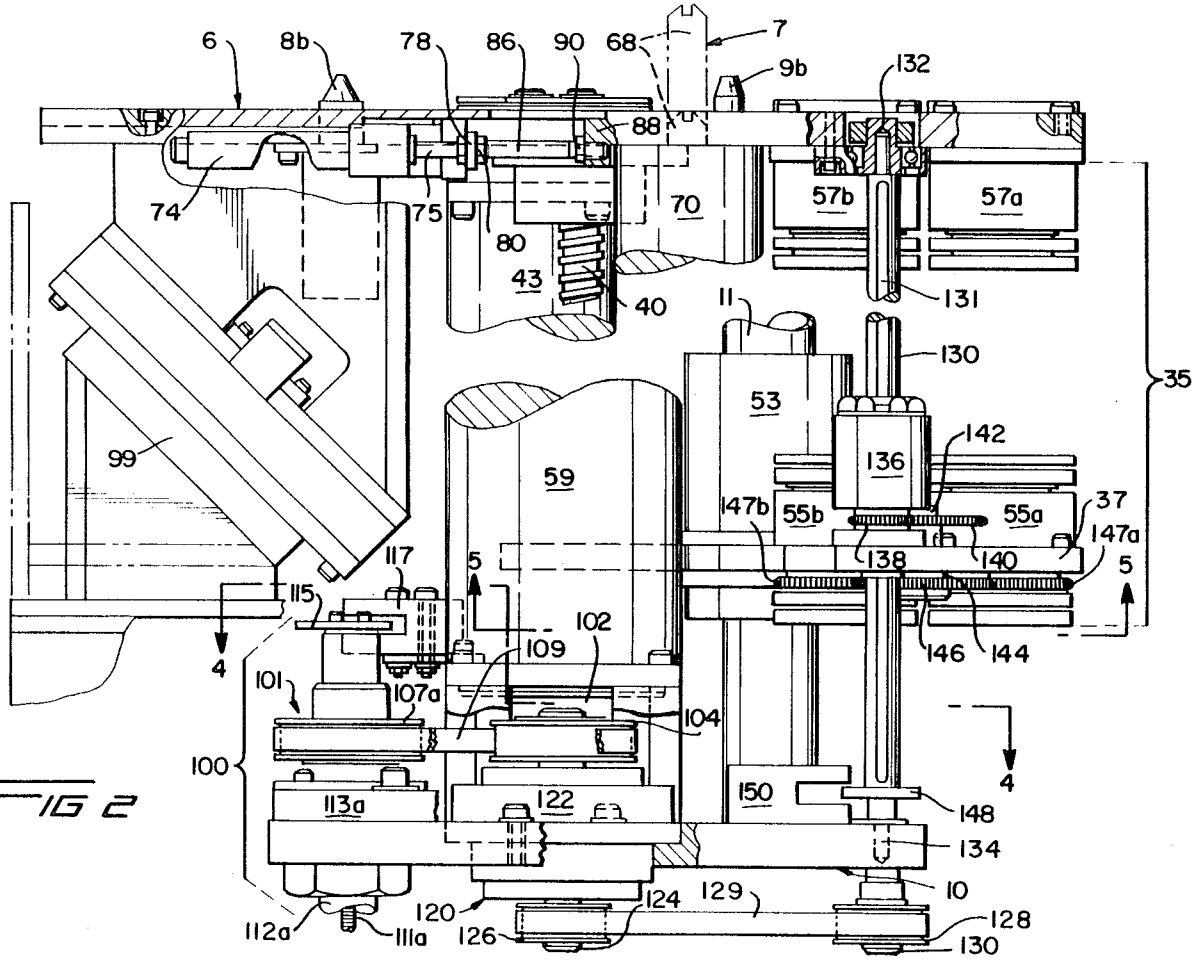
FIG. 2 is a side view of the rotopeening apparatus illustrated in FIG. 1.

With reference now to FIGS. 1 and 2, wherein like numerals designate like components throughout all the several figures, the improved rotopeening tool 1 of the invention is particularly designed for peening the peripherally located heat exchange tubes 2 in the tubesheet 3 of a nuclear steam generator. The tubesheet 3 hydraulically isolates the upper, cylindrically shaped secondary side of the steam generator, and the lower, bowl-shaped primary side 4. As is illustrated in FIG. 1, the inwardly curved walls of the bowl-shaped primary side 4 of the steam generator restrict the access to the heat exchange tubes 2 mounted around the periphery of the tubesheet 3. This poses a significant problem in view of the fact that the insertion and withdrawal of a 30-inch-long peening spindle is required if these peripherally located heat exchange tubes 2 are to be peened throughout the entire extent to which they are surrounded by the tubesheet. Rigid peening spindles could not be used in such peripherly areas, since it would be impossible to properly align them with the open ends of the peripherally located tubes 2 prior to insertion; the inwardly curving walls of the bowl-shaped primary side would mechanically interfere with such an alignment. Even if flexible spindles were used, the problem would still remain unsolved if the length of the stroke of the mechanism used to advance and withdraw the peening spindle were substantially the same length as the spindle itself, because the inwardly curving walls would again interfere with such a mechanism at the downward end of its stroke. While some of the mechanical interference problem may be solved by the use of a flexible peening spindle instead of a rigid spindle, the use of such a flexible spindle introduces additional problems which must be solved before the peripheral peening tool becomes practical, such as the proper and accurate alignment of the distal ends 13*a* and 13*b* of the flexible rotopeening spindles 12*a* and 12*b*. The flexibility which allows the peening spindles 12*a* and 12*b* to be slid completely up through the peripherally located heat exchange tubes 2 also causes them to wobble and slump as they are being manipulated within the primary side 4 of the steam generator. Finally, if a known, state-of-the-art robotic arm such as ROSA is to be used to manipulate the tool, the overall weight of the tool should be no greater than about 50 pounds, so that such known robotic arms can manipulate the tool easily, and without excessive wear.

Generally speaking, the instant invention solves all of the aforementioned problems by the combination of a strong, lightweight frame 5 formed from a top plate 6 and a bottom plate 10, and a novel spindle-advancing mechanism 35 which is mounted on the wall-facing or working side of the frame 5. The advancing mechanism 35 generally includes a reciprocating plate 37 having a riding nut block 39 which rides on a lead-screw 40 driven by an oscillating motor 43. A pair of lower spindle grippers 55*a*, 55*b* are mounted on the wall-facing side of the reciprocating plate 37. As will be described in more detail hereinafter, each of these lower grippers 55*a*, 55*b* includes an inflatable bladder which, when expanded, will tightly grip the generally cylindrical outer housing of the flexible rotopeening spindles 12*a*, 12*b*. The top plate 6 of the frame 5 includes another pair of grippers 57*a*, 57*b* which are aligned with the lower grippers 55*a*, 55*b*. These upper grippers 57*a*, 57*b* likewise include inflatable bladders which are capable of tightly gripping the cylindrical housing of the flexible spindles 12*a*, 12*b* when inflated. To extend or withdraw the flexible spindles 12*a*, 12*b*, the oscillating motor 43 reciprocates the plate 37 up and down between the top and bottom plates 6 and 10 of the frame 5 while the lower and upper grippers 55*a*, 55*b* and 57*a*, 57*b* are alternately actuated and deactuated, as the plate 37 arrives at its maximum and minimum positions within the frame 5. To avoid mechanical interference between the reciprocating plate 37 and the inwardly curving walls of the primary side 4 of the nuclear steam generator, the length L2 of the stroke of the reciprocating plate 37 is chosen so that no mechanical interference will occur between the wall-facing edge of the plate 37, and the walls of the primary side 4. In practice, this amounts to choosing a stroke length L2 which is substantially shorter than the length L1 of the flexible rotopeening spindles 12*a*, 12*b*. The selection of such a short stroke also avoids the bending and breaking of the spindles 12*a*, 12*b* which would likely occur if a single, long stroke were used to advance them. To minimize the weight of the tool 1, all the major components of the frame 5 are formed from high-strength, lightweight magnesium. To further reduce weight and to minimize mechanical complexity, a single motor 59 is used to provide both the orbital and rotary components of motion for the cages 25*a–c*, 29*a–c* and the flappers 27*a–c* and 31*a–c* of the flexible rotopeening spindles 12*a*, 12*b*. Various other advantageous features of the tool 1 will become evident presently.

Specific Description of the Structure and Function of the Invention

With reference again to FIGS. 1 and 2, the tool 1 of the invention includes a frame 5 having a top plate 6 and a bottom plate 10 which are rigidly connected to one another by means of a guide column 11. Near its central portion, the top plate 6 includes a laterally and vertically movable expandable collet assembly 7 for detachably connecting the frame 5 in abutting relationship with the underside of the tubesheet 3, and for assisting in the alignment between the spindle passageways of the upper grippers 57*a*, 57*b* and the open ends of a pair of selected tubes 2. In the preferred embodiment, this expandable collet assembly includes a Model 1776E46G02 "Camlock" manufactured by the Westinghouse Electric Corporation located in Pittsburgh, Pa. The specific mechanism which allows the expandable collet assembly 7 to move both laterally and vertically with respect to the top plate 6 will be discussed in detail at a later point in the specification. However, it should be noted at this juncture that the provision of such a movable collet on top plate 6 makes it far easier for the tool operator to maneuver the distal ends 13*a*, 13*b* of the flexible rotopeening spindles 12*a*, 12*b* into alignment with the open end of a particular heat exchange tube 2.

At its rear portion, the top plate 6 includes a pair of linear pots 8*a*, 8*b*. The purpose of these linear pots 8*a*, 8*b* is to inform the tool operator as to whether or not the top plate 6 has been maneuvered into even, abutting contact with the bottom surface of the tubesheet 3. To this end, each of the linear pots 8*a*, 8*b* includes a top, frustroconical member which is spring biased and which may be depressed downwardly when the top surface of the plate 6 abuts the underside of a tubesheet 3. Each of these frustroconical members is connected to a plunger member (not shown) formed of a ferro-magnetic substance which reciprocates within the interior of an electric coil. The output of these electric coils varies with the longitudinal position of this plunger member in its interior. This output is connected to a control system (also not shown) which in turn actuates an audio or visual display whenever both frustroconical members are simultaneously depressed downwardly. In the preferred embodiment, each of the linear pots 8*a*, 8*b* is a model 2D32650 pot manufactured by Browning Manufacturing Company located in Mayville, Ky. The front portion of the top plate 6 includes a pair of standoff members 9*a*, 9*b* on either side of the collet assembly 7. These standoffs 9*a*, 9*b* help to space the top surface of the plate 6 slightly from the bottom surface of the tubesheet 3 when the frame 5 is maneuvered into a peening position. Such spacing is important, since the open ends of the tubes 2 extend slightly beyond the bottom surface of the tubesheet 3. The spacing provided by the standoffs 9*a*, 9*b* prevents the upper edge of the top plate 6 from striking and deforming the annular flanges formed by the slightly protruding open ends of the heat exchange tubes 2 in the tubesheet 3.

A guide column 11 rigidly connects the top plate 5 to the previously mentioned bottom plate 10 by means of upper and lower mounting caps 11.1 and 11.2 in order to provide a strong and rigid frame structure for the previously mentioned spindle advancing mechanism 35. However, before the spindle advancing mechanism 35 is described in detail, a general description of the principal structural features of the flexible rotopeening spindles 12*a*, 12*b* will be given first. A detailed description of these spindles is given in the previously mentioned U.S. patent application Ser. No. 731,241 filed May 7, 1985 now U.S. Pat. No. 4,616,496, the entire specification of which is hereby expressly incorporated herein by reference.

Each of the flexible rotopeening spindles 12*a*, 12*b* includes a distal end 13*a*, 13*b* which is insertable within the open end of a heat exchange tube 2, and a proximal end 15*a*, 15*b* mounted on a spindle block 33. Each of the rotopeening spindles 12*a*, 12*b* is formed from a plurality of tubular spindle segments 17*a–d* and 18*a–d*, respectively, which are joined together by dogleg joints 19*a–c*, and 20*a–c*, as shown. The dogleg joints 19*a–c* and 20*a–c* allow the particular segments which they interconnect to move forwards and backwards and from side to side with respect to one another. To effect the peening operation, each of the spindle segments 17*a–d* and 18*a–d* includes cages 25*a–c* and 29*a–c* for exposing the interior walls of the tubes being peened to the peening flappers 27*a*–27*c* and 31*a*–31*c*. The proximal ends 15*a*, 15*b* of each of the spindles 12*a*, 12*b* are rotatably mounted within the spindle block 33. The flappers 27*a–c* and 31*a–c* for each of the peening spindles 12*a*, 12*b* are connected to a mandrel (not shown) which is rotatably mounted within each of the spindle bodies. In operation, the mandrels of both of the rotopeening spindles 12*a*, 12*b* are rotated via flexible cables 111a and 111b at approximately 3,000 rpm, while the tubular segments 17*a–d* and 18*a–d* forming the outer housings of these spindles are rotated at about 15 rpm. The combination of rotational movements causes the tiny tungsten carbide peening balls (not shown) mounted along the edges of the flappers 27*a–c* and 31*a–c* to orbit and rotate within the tubular segments 17*a–d*, 18*a–d*, and to whip and flail against the inner surface of the tube 2, thereby mechanically relieving any localized stresses in the walls of the tube 2 created as the result of a hydraulic expansion. As will be described in detail hereinafter, the peening spindles 12*a*, 12*b* are oscillated at the same time that the flappers 27*a–c* and 31*a–c* and the cages 15*a–c* and 29*a–c* are being rotated in order to generate a uniform peening pattern around the interior walls of the tube 2.

Figure 3:
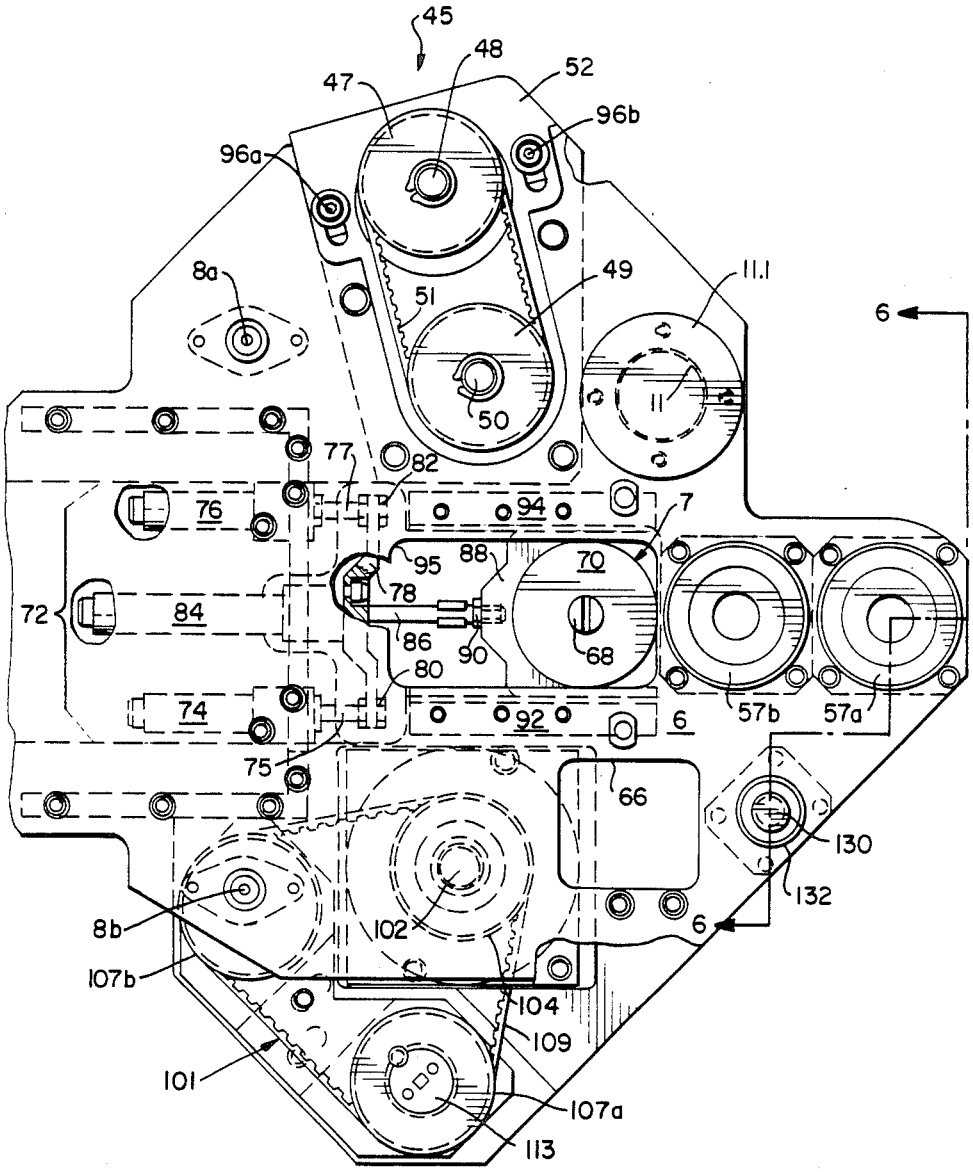
FIG. 3 is a top view of the apparatus illustrated in FIG. 1.

The flexible spindles 12*a*, 12*b* are advanced, withdrawn and reciprocated within the frame 5 by means of the advancing mechanism 35. Mechanism 35 includes the previously mentioned reciprocating plate 37 for both oscillating the peening spindles 12*a*, 12*b* during a peening operation, and for indexing these spindles within the tubes 2 by inserting (or withdrawing) them to a desired extent within a particular pair of heat exchange tubes 2. Such indexing is necessary because the spindles 12*a*, 12*b* do not have enough peening flappers along their respective longitudinal axes to peen the entire length of the tubes 2 which are surrounded by the tubesheet 3 in a single peening operation. Hence, two in tandem peening operations are necessary to peen the entire twenty-two inches of tube 2 surrounded by the tubesheet 3. The reciprocating motion necessary to effect the oscillation, advancement and withdrawal of plate 37 is generated by riding nut block 39, leadscrew 40, and oscillation motor 43. Mounted near the back of the plate 37 is riding nut block 39. This riding nut block 39 is threadedly engaged to the vertically oriented leadscrew 40 which is journalled between the top and bottom plates 6 and 10 of the frame 5. At its bottom end, the leadscrew 40 is coupled to an encoder 42 whose electrical output is connected to a control system (not shown). At its top end, the leadscrew 40 is mechanically connected to the oscillation motor 43 by way of a drive train 45. In the preferred embodiment, motor 43 is a Model 15035 reversible, permanent-magnet motor having a built-in tachometer and encoder and manufactured by Aerotech, Inc., located in Pittsburgh, Pa. With reference now to FIGS. 1 and 3, the drive train 45 includes a drive pulley 47 connected to the output shaft 48 of the oscillating motor 43, and a lead screw pulley 49 connected to the leadscrew 40 through a bearing 50. The rotational motion of the drive pulley 47 is transferred to the leadscrew pulley 49 through a timing belt 51. The distance between the drive pulley 47 and the leadscrew pulley 49 may be adjusted through a tension adjustment plate 52 which is connected onto the top plate 5 by means of nut and bolt assemblies 96*a*, 96*b*.

In operation, the reciprocating plate 37 moves upwardly or downwardly with respect to the frame 5 depending on the direction of rotation of the leadscrew 40. In order to ensure that the reciprocating plate 37 will remain substantially horizontal during such reciprocating movement, the plate 37 rides along the support column 11 through a cylindrical bearing 53 mounted on the plate 37 in the position shown in FIG. 1.

With reference back to FIGS. 1 and 2, the wall-facing edge of the reciprocating plate 37 includes the previously mentioned lower grippers 55*a*, 55*b* arranged in tandem as shown. Each of the lower grippers 55*a*, 55*b* includes a pneumatic cable 56*a*, 56*b* for admitting or venting compressed air to or from the bladders contained therein, thereby selectively expanding or retracting them. Located directly above the lower grippers 55*a*, 55*b* are a pair of upper grippers 57*a*, 57*b* mounted beneath the wall-facing edge of the top plate 5. description of the grippers 55*a*, 55*b* and 57*a*, 57*b* is given hereinafter.

Turning now to FIG. 3, the top plate 5 of the frame 4 includes a small mirror 65 which is mounted along one of the edges of a mirror port 66. The purpose of the mirror 65 is to optically conduct an image of the upper edges of the grippers 57*a*, 57*b* to a television camera 67 mounted on the bottom plate 10 of the frame 5. The image generated by the television cameras 67 is transmitted to a television monitor by way of a cable (not shown), and assists the tool operator in maneuvering the centrally disposed spindle passageways of the upper grippers 57*a*, 57*b* into alignment with the open ends of a pair of tubes 2 to be rotopeened. FIG. 3 also illustrates the details of the laterally and vertically movable expandable collet assembly 7 mentioned earlier. The expandable collet 7 includes a collet member 68 which is vertically extendable into or retractable within a cylindrical housing 70 mounted on the underside of the top plate 5. The movement of the collect member 68 is pneumatically operated in a manner well known in the art. The cylindrical housing 70, along with its collet member 68, is laterally movable with respect to the top plate 5 by means of a lateral movement mechanism 72. This mechanism 72 includes two laterally disposed double-acting cylinders 74 and 76, each of which includes an output rod 75 and 77. These output rods are connected to either end of a yoke 78 by means of mounting nuts 80 and 82. Centrally mounted in this yoke 78 is still another double-acting cylinder 84. The output rod 86 of the centrally disposed cylinder 84 is connected to a cylinder carriage 88 through a mounting nut 90. The cylinder carriage 88 slidably mounts the cylindrical housing 70 which houses the collect member 68 of the collect assembly 7. Specifically, the lateral edges of the cylinder carriage 88 are slidably retained to the underside of the top plate 5 by means of a pair of parallel rail members 92 and 94.

In operation, the cylinder carriage 88 is capable of assuming four discrete positions along the rail members 92 and 94. When all of the cylinders 74, 76 and 84 are retracted, the expandable collect assembly 7 is withdrawn to its maximum extent towards the pneumatic cylinders 74, 76 and 84 until its cylindrical housing 70 engages the left edge of the rectangular slot 95 in the top plate 6. The expandable collect assembly 7 is moved in a first intermediate position toward the upper grippers 57*a*, 57*b* when the laterally disposed cylinders 74 and 76 are simultaneously extended while the centrally disposed cylinder 84 remains in a withdrawn position. The expandable collect assembly 7 is moved into a second intermediate position which is closer to the upper grippers 57*a*, 57*b* when the centrally disposed cylinder 84 is extended with the two laterally disposed cylinders 74 and 76 in a withdrawn position. Finally, the expandable collect assembly 7 is moved even closer to the grippers 57*a*, 57*b* until its cylindrical housing 70 abuts the right edge of the rectangular slot 95 when all of the cylinders 74, 76 and 84 are simultaneously extended. To further enhance the overall manipulability of the tool 1, a two-position coupling 99 is provided near the rear of the frame 5. This coupling is compatible with the ROSA robotic arm designed, developed, and patented by the Westinghouse Electric Corporation.

Figure 4:
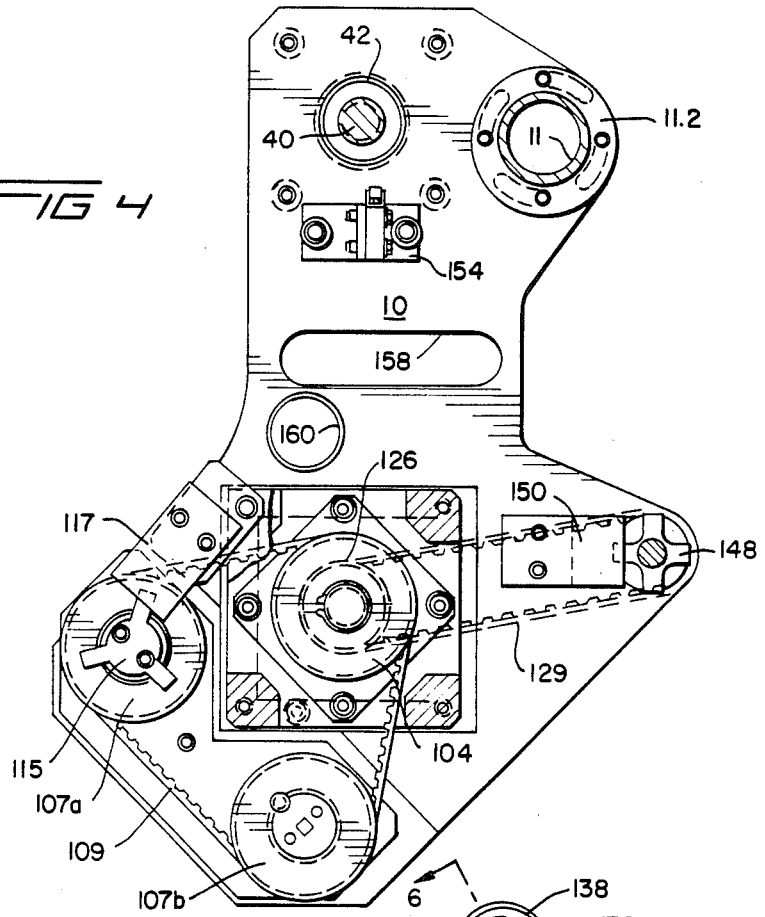
FIG. 4 is a cross-sectional view of the apparatus along the line 4—4 in FIG. 1.
Figure 5:
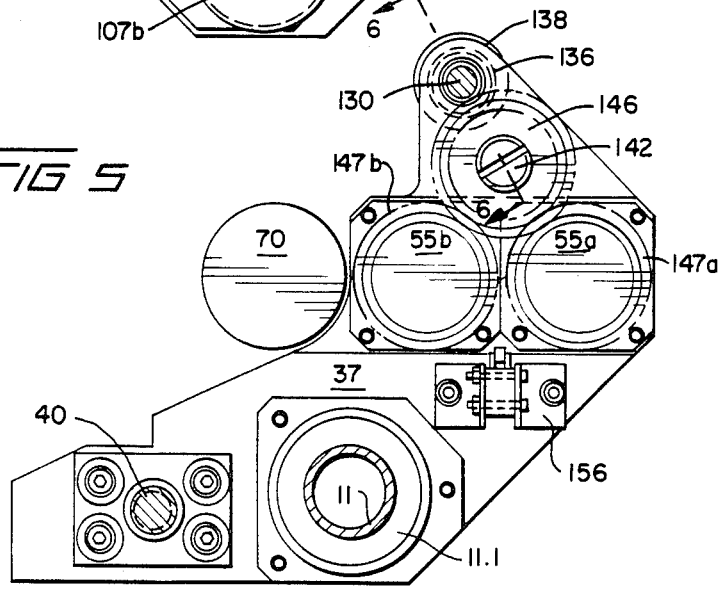
FIG. 5 is another cross-sectional view of the apparatus along the line 5—5 of FIG. 1.

With specific reference now to FIGS. 2, 3 and 4, the tool 1 includes a rotary and orbital drive assembly 100 mounted on the bottom plate 10 for simultaneously rotating the flappers 27*a–c*, and 31*a–c*, and the cages 25*a–c*, and 29*a–c*, of the peening spindles 12*a* and 12*b*. The rotary drive train 101 of the rotary and orbital drive assembly 100 rotates the flappers 27*a–c* and 31*a–c* by way of the previously mentioned flexible shafts 111*a*, 111*b*. This drive train 101 starts with the output shaft of the previously mentioned orbital and rotary motor 59. In the preferred embodiment, motor 59 is a Model 17017 permanent magnet-type electric motor manufactured by Aerotech, Inc. located in Pittsburgh, Pa. Like the oscillating motor 43, motor 59 includes a built-in encoder and tachometer whose output is electrically connected to the control system of the invention. The output shaft of the rotary and orbital motor 59 rotates at approximately 3,000 rpm, and is connected to the output shaft 102 of the rotary drive train 101. A rotary drive pulley 104 is connected to this output shaft 102. The rotational output of the drive pulley 104 is transferred to drive shaft pulleys 107*a*, 107*b* through a timing belt 109. Each of the drive shaft pulleys 107*a*, 107*b* is in turn connected to a bearing assembly 113*a*, 113*b*. A triangular flag 115 is mounted on the upper end of the bearing assembly 113*a*. The legs of this triangular flag pass through a slot in a magnetic encoder 117, whose output is in turn connected to the previously mentioned control system. The lower ends of the bearing assemblies 113*a*, 113*b* are connected to the flexible shafts 111*a*, 111*b* as previously indicated. The provision of the triangular flag 115 and magnetic encoder 117 provides a direct indication of the rotational speed of the flexible shafts 111*a*, 111*b*, and hence of the rotational speed of the flappers 27*a*–27*c* and 31*a*–31*c* rotatably mounted in the spindles 12*a*, 12*b*.

Turning now to the orbital drive 120 of the rotary and orbital drive assembly 100, a harmonic gear reducer 122 is connected on its input end to the previously mentioned output shaft of the rotary and orbital motor 59. The harmonic gear reducer reduces the rotational speed of its input shaft by a factor of 100:1. Since the shaft of the orbital and rotational motor 59 is rotating at 3,000 rpm, the output shaft 124 of the harmonic gear reducer 122 is reduced to a rotational speed of 30 rpm. An orbital drive pulley 126 is connected to the output shaft 124 as shown. This pulley transfers its rotational motion to a gripper gear train pulley 128 by way of a timing belt 129. This pulley 128 is connected to a spline shaft 130 rotatably mounted in the top plate 6 by means of a top plate bearing 132, and the bottom plate 10 by means of a bottom plate bearing 134. The spline shaft 130 includes three axial flutes (only one of which is visible) at 120° intervals around its circumference.

With reference now to FIGS. 2 and 6, the reciprocating plate 37 is slidably and rotatably mounted onto the spline shaft 130 by means of a bearing 135. A ball spline 136 which is rotatably connected to the plate bearing 135 is further slidably engaged to the spline shaft 130. The ball spline 136 includes three longitudinal ball bearing races spaced 120° around its circumference which are rotatably received within the fluts 131 of the spline shaft 130. Hence, while the ball spline 136 is free to slide along the longitudinal axis of the spline shaft 130, it must rotate along with the shaft 130 whenever the gripper gear train pulley 128 is rotated by the output of the harmonic gear reducer 122. The ball spline 136 includes a short output shaft at its bottom which is circumscribed by a spline drive gear 138. The teeth of the drive gear 138 mesh with the teeth of a larger diameter reducing gear 140. The reducing gear 140 is connected to a gear shaft 142 rotatably mounted to the reciprocating plate 37 by means of a bearing 144. The bottom end of the gear shaft 142 is connected to a common drive gear 146 of the same diameter as the reducing gear 140. This common drive gear 146 intermeshes with the teeth of gripper drive gears 147*a*, 147*b* which are connected to the rotatable, internal housings 164 of each of the lower grippers 55*a*, 55*b*. A more comprehensive description of the rotatable inner housings of the grippers 55*a*, 55*b* will be presented shortly. The lower end of the spline shaft 130 is circumscribed by a square flag 148 whose corners pass through a slot in still another magnetic encoder 150. Like the output of the encoder 117, the output of encoder 150 is electrically connected to the input of the control system of the invention. The provision of a square flag 148 on the spline shaft 130 and a magnetic encoder 150 provides a direct indication of the actual rpm of the internal housings 164 of each of the lower grippers 55*a*, 55*b*, which in turn is an indication of the orbital motion imparted to the rotatable mandrels within the spindles 12*a*, 12*b*. For control purposes, a bottom limit switch 154 is provided on the bottom plate 10 of the frame 5, while a top limit switch 156 is mounted on the bottom surface of the reciprocating plate 37. The outputs of these switches 154, 156 are also connected to the control system of the invention. Their purpose is to inform the tool operator as to when the reciprocating plate 37 arrives at its bottommost position within the frame 5, and the spindle block 33 arrives at its topmost position with respect to the reciprocating plate 37.

With reference now to FIG. 7, each of the lower grippers 55*a*, 55*b* includes an external housing 162 which circumscribes the mid-portion of the previously mentioned internal housing 164. A pair of circular ball bearings 166*a*, 166*b* are disposed between the external and internal housings 162, 164 so that the internal housing 164 is freely rotatable with respect to the external housings 162 (which is stationarily mounted onto the reciprocating plate 37 by means of a circular retainer 167, as is shown in FIG. 6). An expandable bladder 168 having a generally tubular shape is mounted within the cylindrical interior of the internal housing 164. The bladder 168 includes a pair of upper and lower annular flanges 170 which serve to space its cylindrical walls a short distance from the interior walls of the internal housing 164. Bladder 168 further includes upper and lower circular flanges 172, 172 which overlap the top and bottom edges of the internal housing 164 as shown. An upper cap 174 and a lower cap 175 are sealingly mounted over the upper and lower ends of the internal housing 164 by means of upper mounting screws 176 and lower mounting screws 178. The caps 174, 175 include upper and lower sealing skirts 180, 182, respectively for snugly engaging the upper and lower annular flanges 170*a*, 170*b* against the upper and lower edges of the internal housing 164 so that an air-tight annulus is defined in the space between the central outer wall of the bladder 168, and the internal wall of the internal housing 164. Both the external and internal housings 162, 164 include air passages 184, 185, respectively, which are connected to a source of pressurized air (not shown) through the previously described pneumatic cables 56*a*, 56*b*. Compressed air entering the external housing 162 is prevented from escaping through the ball bearings 166*a*, 166*b* by upper and lower O-rings 187, 189 which circumscribe the internal housing 164 on either side of the air passage 185 as shown. In the preferred embodiment, the expandable bladder is formed from a polyurethane plastic such as Pellethane® of between 80 and 90 durometers. Such a hardness allows the inflatable bladders which are present in all of the grippers sufficient flexibility to securely grip their respective peening spindles without excessively deforming into the cages 25*a*–*c* and 29*a*–*c* of the spindles 12*a*, 12*b*. Additionally, the walls are preferably between 0.050 and 0.100 of an inch thick, and 90–110 pounds of air pressure are used to extend the walls of the bladders 168 to the phantom position shown in order to grip the spindles 12*a*, 12*b*. It should be noted that the structure of the upper grippers 57*a*, 57*b* is very similar to the lower grippers 55*a*, 55*b*, with the exception that the upper grippers do not include separate and mutually rotatable internal and external housings, since this feature is not necessary for their operation.

In operation, a robotic arm positions the tool 1 within the bowl-shaped primary side 4 of a nuclear steam generator with the side of the frame 5 carrying the flexible rotopeening spindles 12*a*, 12*b* and the advancing mechanism 35 facing the peripheral region of the tubesheet 3. The final positioning of the frame 5 within the bowl-shaped primary side 4 is carried out by the tool operator, who visually monitors the position of the top plate 6 of the tool 1 with respect to the tubesheet 3 through television camera 67 and mirror 65. After the centrally disposed, spindle conducting passages of the upper grippers 57*a*, 57*b* have been properly aligned with a pair of peripherally located heat exchange tubes 2 which the operator desires to peen, the expandable collet assembly 7 will be laterally moved, if necessary, in order that the collet member 68 (which is now retracted within cylindrical housing 70) may be inserted into the open end of a nearby heat exchange tube 2. Once this is accomplished, the tool operator actuates the pneumatic cylinder within the cylindrical housing 70, and extends the collet member 68 into the open end of the tube 2, and expands it so as to secure the frame 5 of the tool 1 to the underside of the tubesheet 3. To make sure that the top plate 6 is properly aligned in a parallel relationship with the underside of the tubesheet 3, the tool operator next checks the outputs of the linear pots 8*a*, 8*b*. Both the linear pots 8*a*, 8*b* should indicate that their respective, depressible frustroconical members have been pressed down toward the top plate 6 by the lower surface of the tubesheet 3.

All during these initial positioning steps, the distal ends 13*a*, 13*b* of the flexible rotopeening spindles 12*a*, 12*b* have been positioned below the upper surfaces of the upper grippers 57*a*, 57*b* so that they will not interfere with the proper positioning of the top plate 6 of the frame 5 against the underside of the tubesheet 3.

The microswitch 154 on the bottom plate 10 of the frame 5 is used to confirm that the reciprocating plate 37 of the advancing mechanism 35 is in its lowermost position, which in turn means that the distal ends 13*a*, 13*b* of the spindles 12*a*, 12*b* are below the upper surface of their respective upper grippers 57*a*, 57*b*.

During the first phase of the peening operation, the operator confirms again that microswitch 154 is actuated, which in turn tells him that the reciprocating plate 37 is at its lowermost position within the frame 5. He then actuates the oscillating motor 43, and the upper and lower grippers 57*a*, 57*b*, and 55*a*, 55*b* in order to incrementally advance the spindles 12*a*, 12*b* up through the open ends of the selected heat exchange tubes 2. The control system coordinates the gripping and ungripping of the upper and lower grippers 57*a*, 57*b* and 55*a*, 55*b*, as well as the direction of rotation of the oscillating motor 43 in order to achieve this desired advancement. The control system utilizes three basic process steps in implementing this coordination. First, while the reciprocating plate 37 is at its bottommost position against the microswitch 154, it opens a solenoid-operated valve (not shown) which allows air into the lower grippers 55*a*, 55*b*, while at the same time closing a solenoid-operated valve (again not shown) which controls the flow of compressed air to the upper grippers 57*a*, 57*b*. Hence, the peening spindles 12*a*, 12*b* are gripped solely by the lower grippers 55*a*, 55*b* at this juncture, and are not gripped by the upper grippers 57*a*, 57*b* at all. The control system then commands the oscillating motor 43 to rotate the leadscrew 40 so that the reciprocating plate 37 ascends toward the underside of the top plate 6. When the encoder on the oscillating motor 43 reaches a preset value indicating that the reciprocating plate 37 is in its topmost position, the control system opens the solenoid-operated valve which admits compressed air into the upper grippers 57*a*, 57*b*, causing them to grip the spindles 12*a*, 12*b* while closing the solenoid-operated valve which was admitting compressed air into the lower grippers 55*a*, 55*b*, thereby causing them to ungrip the spindles 12*a*, 12*b*. At the same time, the control system reverses the direction of the oscillating motor 43, which causes the leadscrew 40 to move the reciprocating plate 37 downwardly, back toward the microswitch 154. When the reciprocating plate 37 strikes the microswitch 154 again, the cycle is repeated. The feeding operation is repeated until the spindle block 39 strikes the microswitch 156 located on the underside of the reciprocating plate 37, indicating that the spindles 12*a*, 12*b* are fully inserted with respect to the lower grippers 57*a* and 57*b*. The reciprocating plate 37 is then advanced one last time, inserting the spindles 12*a* and 12*b* into the tubes 2 until the encoder on the oscilating motor 43 reaches a preset value which indicates that the spindles 12*a*, 12*b* have advanced into the tubes 2 to the maximum extent possible. It should be noted that while the spindles 12*a*, 12*b* are being advanced into the open ends of the tubes 2, the orbital and rotational motor 59 is simultaneously actuated to rotate the flappers 27*a*–27*c* and 31*a*–31*c* and the cages 25*a*–25*c* and 29*a*–29*c* of the spindles 12*a*, 12*b* so that the flappers will not become bound between the spindle bodies and the open ends of the tubes 2 during the initial advancement.

Once the spindles 12*a* and 12*b* have been completely advanced within the tubes 2, the peening operation may begin. During the peening operation, the orbital and rotational motor 59 is actuated in order to rotate the flappers 27*a*–*c* and 31*a*–*c* at approximately 3,000 rpm while rotating the cages 25*a*–*c* and 29*a*–*c* at approximately 15 rpm. At the same time, the oscillating motor 43 is operated so that it rapidly reciprocates the reciprocating plate 37 throughout an amplitude of 0.9 inches at 28 cycles per minute. The orbital motion imparted to the flappers of the spindles 12*a*, 12*b* as a result of the rotation of the cages, coupled with the reciprocating motion generated by the oscillating motor 43, renders a uniform peening pattern throughout the interior walls of the tubes 2.

After the regions of the tubes immediately adjacent the flappers 27*a*–*c* and 31*a*–*c* have been sufficiently peened, the spindles are indexed downwardly approximately 5.64 inches by the oscillating motor 43. After this indexing motion has been completed, the oscillating motor 43 and the orbital and rotational motor 59 are both operated in a peening mode again, so that the lowermost portions of the tubes 2 surrouned by the tubesheet 3 may be peened in the same manner that the uppermost portions of these tubes were peened. For a more complete description of the manner in which the spindles 12*a*, 12*b* are used to peen the inside walls of heat exchange tubes 2, reference is again made to patent application Ser. No. 731,241, filed May 7, 1985.

In closing, it should be noted that the provision of the magnetic encoders 117 and 150, in combination with the built-in encoders and tachometers in the motors 43 and 59, provide the tool operator with the means to check whether or not any belt slippage is occurring between the timing belts 51, 129, and 109 and their respective pulleys.

We claim:

1. An improved apparatus for rotopeening the inside wall of a conduit of the type having a rotopeening spindle that includes a flexible and rotatable outer housing of length L1, comprising:

(a) advancing means including first and second selectively actuatable grippers that are engageable to the spindle housing, at least one of which is reciprocably movable with respect to the other for both supporting and advancing the entire length L1 of said flexible spindle housing through an open end of said conduit, wherein the maximum length L2 of said advancing means is less than the length L1 of the housing of the rotopeening spindle, and (b) a frame means for supporting said advancing means in a desired position with respect to said open end of said conduit.

2. An improved apparatus for rotopeening the inside wall of a conduit as described in claim 1, wherein said advancing means includes means for rotating said rotable outer housing of said rotopeening spindle.

3. An improved apparatus for rotopeening the inside wall of a conduit as described in claim 1, wherein each of said grippers includes a fluidly expandable bladder for selectively gripping said spindle.

4. An improved apparatus for rotopeening the inside wall of a conduit as described in claim 1, wherein one of said grippers is rotatably mounted with respect to said frame means for gripping and rotating said spindle.

5. An improved apparatus for rotopeening the inside wall of a conduit as described in claim 2, further including oscillating means for oscillating said spindle along its longitudinal axis while said advancing means rotates said spindle.

6. An improved apparatus for rotopeening the inside wall of a conduit as described in claim 1, wherein said frame means includes a means for aligning the distal end of said spindle with the open end of a selected conduit.

7. An improved apparatus for rotopeening the inside wall of a conduit as described in claim 1, further including means for connecting said frame means with a robotic arm.

8. An improved apparatus for rotopeening the inside wall of a conduit as described in claim 2, further including a remote visual monitoring means mounted on said frame means for allowing said frame means to be remotely positioned with the distal end of said spindle near the open end of a selected conduit.

9. An improved apparatus for remotely rotopeening the inside walls of the peripheral tubes in a tubesheet, wherein the periphery of the tubesheet abuts a wall, comprising:

(a) at least one rotopeening spindle having a flexible and rotatable outer housing of length L1, and (b) advancing means including first and second selectively actuatable grippers that are engageable to the spindle housing, at least one of which is reciprocably movable with respect to the other for both supporting the spindle and for remotely and incrementally advancing the flexible spindle housing into the open end of a selected tube, wherein the maximum length L2 of the advancing means is less than the length L1 of the rotatable spindle housing to allow the apparatus to be easily positioned adjacent to the periphery of the tubesheet, and (c) a frame means for detachably connecting the advancing means to the tubesheet in a desired position with respect to the open end of said tube, including first and second selectively actuatable grippers that are engageable to the spindle housing, at least one of which is reciprocably movable with respect to the other.

10. An improved apparatus as described in claim 9, wherein said advancing means includes means for rotating said rotatable outer housing of said rotopeening spindle.

11. An improved apparatus as described in claim 9, wherein each of said grippers includes a fluidly expandable bladder for selectively gripping said spindle.

12. An improved apparatus as described in claim 9, wherein one of said grippers is rotatably mounted with respect to said frame means gripping and rotating said spindle.

13. An improved apparatus for remotely rotopeening the inside walls of the peripheral tubes in a tubesheet, wherein the periphery of the tubesheet abuts a wall, comprising:

(a) at least one rotopeening spindle having a flexible and rotatable outer housing of length L1;

(b) a frame means for supporting said spindle in alignment with the open end of a selected tube, wherei said frame means includes a wall abutting side where said spindle is movably mounted and (c) an advancing means including first and second grippers for selectively gripping and ungripping said spindle, said first gripper being fixedly mounted on said wall abutting side of said frame, and said second gripper being reciprocably movable with respect to said first gripper for both supporting said flexible spindles and remotely and incrementally advancing the spindle through the open end of said selected peripheral tube in said tubesheet, wherein the length L2 of said advancing means is less than the length L1 of the rotatable spindle housing to allow the wall abutting side of the frame means to be positioned adjacent to the wall surrounding the tubesheet.

14. An improved apparatus as described in claim 13, wherein said second gripper is rotatably mounted and connected to a drive means for rotating said housing of said spindle.

15. An improved apparatus as described in claim 13, wherein both said first and second grippers include fluidly expandable bladders for selectively gripping and ungripping the housing of the spindle.

16. An improved apparatus as described in claim 13, wherein said flexible housing of said spindle is segmented by a plurality of equi-distantly spaced joints along its length, and wherein the length of the stroke of the reciprocably movable second gripper is less than the lengthwise distance between any two of said joints.

17. An improved apparatus for remotely rotopeening the inside walls of the peripheral tubes in a tubesheet, wherein the periphery of the tubesheet abuts a wall, comprising:

(a) at least one rotopeening spindle having a flexible and rotatable outer housing of length L1;

(b) a frame means for supporting said spindle in alignment with an open end of a tube wherein said frame means includes a wall abutting side where said spindle is movably mounted, wherein said frame means includes alignment means for positioning said spindle into alignment with the open end of a selected tube and (c) an advancing means mounted on said wall abutting side of said frame for both supporting said flexible spindle and for remotely and incrementally advancing the spindle through said open end of a selected peripheral tube in said tubesheet, wherein the length L2 of said advancing means is less than the length L1 of the rotatable spindle housing to allow the wall abutting side of the frame means to be positioned adjacent to the wall surrounding the tubesheet.

18. An improved apparatus as described in claim 17, wherein said alignment means also detachably mounts said frame means onto said tubesheet.

19. An improved apparatus as described in claim 17, wherein said alignment means includes an expandable collet slidably mounted onto said frame means for detachably connecting said frame means onto said tubesheet, and lateral movement means for selectively slidably moving said expandable collect relative to said frame means in order to align said spindle with the open end of said selected tube.

20. An improved apparatus as described in claim 19, wherein said lateral movement means includes a fluidly operated cylinder.

21. An improved apparatus as described in claim 13, further including a TV camera and mirror mounted on said frame means for remotely monitoring the positioning of said apparatus with respect to said tubesheet.

22. An improved apparatus as described in claim 15, wherein said second gripper includes an internal housing which surrounds the bladder, and an external housing which is rotatably mounted over the internal housing which is fixedly mounted with respect to said frame means.

23. An improved apparatus as described in claim 22, wherein said internal housing is circumscribed by a spur gear which is mechanically engaged to a driving means for rotating said internal housing and said gripping bladder.

24. An improved apparatus for remotely rotopeening the inside walls of the peripheral tubes in a tubesheet, wherein the periphery of the tubesheet abuts a wall, comprising:

(a) at least one rotopeening spindle having a flexible and rotatable outer housing formed from a plurality of jointed segments, each of which is substantially the same length;

(b) a frame means for supporting said spindle, wherein said frame means includes a wall abutting side where said spindle is movably mounted, and a top plate having a connecting and aligning means for detachably connecting said top plate to the tubesheet, and for aligning the spindle into registry with the open end of a selected tube, and (c) an advancing and retracting means mounted on said wall abutting side of said frame means including a first spindle gripper mounted on said top plate of said frame means for selectively gripping and ungripping the housing of the spindle, and a second spindle gripper reciprocably movable on said wall abutting side of said frame means for selectively gripping and ungripping the housing of the spindle in cooperation with said first spindle gripper in order to remotely and incrementally advance and retract said spindle housing through said top plate, wherein the stroke of said reciprocably movable second gripper is less than the length of two of the segments forming the spindle housing in order to insure that the motion generated by the reciprocably movable second gripper will serve to insert the flexible spindle into the open end of a selected tube.

25. An improved apparatus as described in claim 24, wherein the maximum length L2 of the advancing and retracting means is substantially less than the length L1 of the rotopeening spindle to allow the wall abutting side of the frame means to be easily positioned adjacent to the wall surrounding the tubesheet.

26. An improved apparatus as described in claim 24, wherein said second gripper is rotatably mounted and connected to a drive means for rotating said housing of said spindle.

27. An improved apparatus as described in claim 24, wherein both said first and second grippers include pneumatically expandable bladders for selectively gripping and ungripping the housing of the spindle.

28. An improved apparatus as described in claim 27, wherein said second gripper includes an internal housing which surrounds the bladder, and an external housing which is rotatably mounted over the internal housing which is fixedly mounted with respect to said frame means.

29. An improved apparatus as described in claim 28, wherein said internal housing is circumscribed by a spur gear which is mechanically engaged to a driving means for rotating said internal housing and said gripping bladder.

30. An improved apparatus as described in claim 29, wherein said internal housing includes a fluid port for placing the exterior surface of said expandable bladder into communication with a source of pressurized fluid.

31. A process for rotopeening a selected conduit with a rotopeening spindle having a housing that includes a distal end that is insertable within the open end of said conduit, and an advancing means having a gripping means for gripping and advancing said spindle, comprising the steps of aligning the distal end of the spindle with said open end of said selected conduit, incrementally advancing said housing into said open conduit end with said gripping means.

32. A process for rotopeening a selected conduit with a rotopeening spindle having a flexible and rotatable housing, and an advancing and retracting means which includes first and second grippers for gripping and ungripping said spindle housing, wherein said second gripper is reciprocably movable with respect to the first gripper, and a frame means for interconnecting said flexible spindle and said advancing and retracting means, comprising the steps of:

(a) gripping said spindle with at least one of said grippers with the distal end of said spindle positioned below the distal end of the first gripper;

(b) positioning said frame means so that the distal end of the spindle is aligned with an open end of a selected conduit;

(c) ungripping said spindle with said first gripper and gripping said spindle with said second gripper while moving said second gripper to a position closer to said open conduit end;

(d) gripping said spindle with said first gripper and ungripping said spindle with said second gripper while moving said second gripper to a position further away from said open conduit end, and (e) repeating steps (c) and (d) until said spindle has been completely inserted into said conduit.

33. A process as described in claim 32, wherein said second gripper is rotatably mounted, and further including the step of rotating said flexible spindle housing.

34. A process as described in claim 32, further including the step of retracting said spindle from the open end of said conduit after said conduit has been rotopeened by gripping said spindle with the first gripper and ungripping said spindle with the second gripper to a position closer to said open conduit end, and then ungripping said spindle with the first gripper and gripping said spindle with the second gripper while moving the second gripper to a position farther away from said open conduit end.

35. An improved apparatus for rotopeening the inside wall of a conduit with a rotopeening spindle of the type having a flexible and elongated outer housing, comprising:

(a) advancing means for both supporting and advancing said rotopeening spindle with respect to the open end of a conduit, including a reciprocable gripper for gripping, advancing and ungripping the spindle housing to insert it into said condiut, and (b) a frame means connected to said advancing means for supporting the same and for positioning the rotopeening spindle into a desired position with respect to the open conduit end.

36. An improved apparatus for rotopeening the inside wall of a conduit with a rotopeening spindle having a flexible and elongated outer housing that is rotatable, comprising:

(a) advancing means for both supporting and advancing said rotopeening spindle with respect to the open end of a conduit, including a reciprocable and rotatable gripper for gripping, advancing, and ungripping the spindle housing to insert it into said conduit, and rotating the spindle housing in order to rotopeen the inside wall of the conduit, and (b) a frame means connected to said advancing means for supporting the same and for positioning the rotopeening spindle into a desired position with respect to the open end of the conduit.

* * * * *